US006695752B2

(12) United States Patent
Lee

(10) Patent No.: US 6,695,752 B2
(45) Date of Patent: Feb. 24, 2004

(54) WHEEL-TYPE RESISTANCE DEVICE FOR A BICYCLE EXERCISER

(76) Inventor: Lung-Huei Lee, No. 1, Lane 1561, Sec. 1, Chung-Shan Rd., Ta-Chia Chen, Taichung Hsien (TW)

( * ) Notice: Subject to any disclaimer, the term of this patent is extended or adjusted under 35 U.S.C. 154(b) by 241 days.

(21) Appl. No.: 10/014,642

(22) Filed: Dec. 11, 2001

(65) Prior Publication Data

US 2003/0109362 A1 Jun. 12, 2003

(51) Int. Cl.[7] ..... A63B 69/16

(52) U.S. Cl. ..... 482/63; 482/51; 482/57; 482/110

(58) Field of Search ..... 482/51, 52, 54, 482/57, 55, 56, 60, 61, 63, 110, 148, 903, 908

(56) References Cited

U.S. PATENT DOCUMENTS 5,076,573 A * 12/1991 Lo ..... 482/5
5,094,447 A * 3/1992 Wang ..... 482/63
5,310,392 A * 5/1994 Lo ..... 482/63
5,879,273 A * 3/1999 Wei et al. ..... 482/63

* cited by examiner

*Primary Examiner*—Nicholas D. Lucchesi
*Assistant Examiner*—Tam Nguyen
(74) *Attorney, Agent, or Firm*—Harness, Dickey & Pierce, P.L.C.

(57) ABSTRACT

A wheel-type resistance device for providing a resisting force to a bicycle exerciser, includes two swing arms pivotally mounted on an exerciser frame and outboard to two side walls of a flywheel so as to swingable to be remote from or close to the side walls respectively in first and second positions. A right magnet member and a left magnetically attractive member are mounted respectively on the swing arms such that movement to the second position will cause an increased dragging force on the flywheel. A force adjusting cable is connected to the swing arms and is operable to pull the swing arms, as well as the right magnet member and the left magnetically attractive member, to the second position.

4 Claims, 7 Drawing Sheets

WHEEL-TYPE RESISTANCE DEVICE FOR A BICYCLE EXERCISER

BACKGROUND OF THE INVENTION

1. Field of the Invention

This invention relates to a resistance device for a bicycle exerciser, more particularly to a wheel-type resistance device which can provide an adjustable magnetic resisting force to the bicycle exerciser.

2. Description of the Related Art

Referring to FIGS. 1 and 2, a conventional wheel-type resistance device for a bicycle exerciser is shown to include a flywheel 1 mounted on a bicycle frame 3 and driven to rotate by a pedaling action of a user. A magnet assembly 2 is mounted swingably on the frame 3 by a linkage assembly 4, and has two walls 202 disposed adjacent to two lateral walls of the flywheel 1 and having a plurality of magnets 201 mounted thereon. The linkage assembly 4 includes two parallel cranks 401 with lower ends 402 mounted rotatably on the frame 3 and upper ends 405 mounted rotatably on a coupler 403 secured on the magnet assembly 2. One of the cranks 401 is connected to one end of a connecting bar 404. The other end of the connecting bar 404 is connected to a sliding block 502 of an adjustment member 5. The sliding block 502 engages threadedly a guiding threaded bolt 501 which is rotated by a motor 503 to move the sliding block 502 so as to adjust the position of the magnet assembly 2 relative to the flywheel 1, thereby adjusting the resisting force of the magnet assembly 2 to the flywheel 1.

It is noted that the conventional resistance device has a complicated structure and is inconvenient to assemble. Moreover, use of the linkage assembly 4 and the adjustment member 5 involves increased manufacturing and maintenance costs.

SUMMARY OF THE INVENTION

The object of the present invention is to provide a wheel-type resistance device which has a fewer number of components, thereby reducing the manufacturing and maintenance costs.

According to this invention, the wheel-type resistance device includes a magnetically permeable flywheel which is mounted on and which is rotatable about an axle that is mounted on a frame of a bicycle exerciser and that extends in an axial direction. The flywheel is driven to rotate by a pedaling action of a user, and has two side walls opposite to each other in the axial direction. Right and left swing arms have pivot ends which are adapted to be mounted pivotally on the frame of the bicycle exerciser about a swing axis transverse to the axial direction and outboard to a respective one of the side walls of the flywheel, and swing ends which are disposed opposite to the pivot ends in a direction radial to the axle so as to swing relative to the pivot ends about the swing axis to be remote from or close to each other respectively in a first or second position. Each of the right and left swing arms further includes a mounting member which is disposed between the pivot and swing ends and which extends in the axial direction to terminate at a mounting surface that is remote from or close to the respective one of the side walls respectively in the first or second position. Two biasing members are disposed to bias the mounting surfaces of the right and left swing arms to move from the second position to the first position. A right magnet member is mounted on and is movable with the mounting surface of the right swing arm. A left magnetically attractive member is mounted on and is movable with the mounting surface of the left swing arm. Thus, the movement of the right magnet member and the left magnetically attractive member from the first position to the second position will cause an increased dragging force on the flywheel as a result of interaction between the magnetically permeable flywheel and an increased strength of magnetic field established between the right magnet member and the left magnetically attractive member. A force adjusting cable has two cable ends which are respectively and tensely connected to the swing ends of the right and left swing arms, and an intermediate portion which is disposed between the cable ends and which is adapted to be pullably disposed on the frame of the bicycle exerciser. The intermediate portion is operable to pull the swing ends to the second position, thereby bringing the right magnet member and the left magnetically attractive member to the second position against the action of the biasing members.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
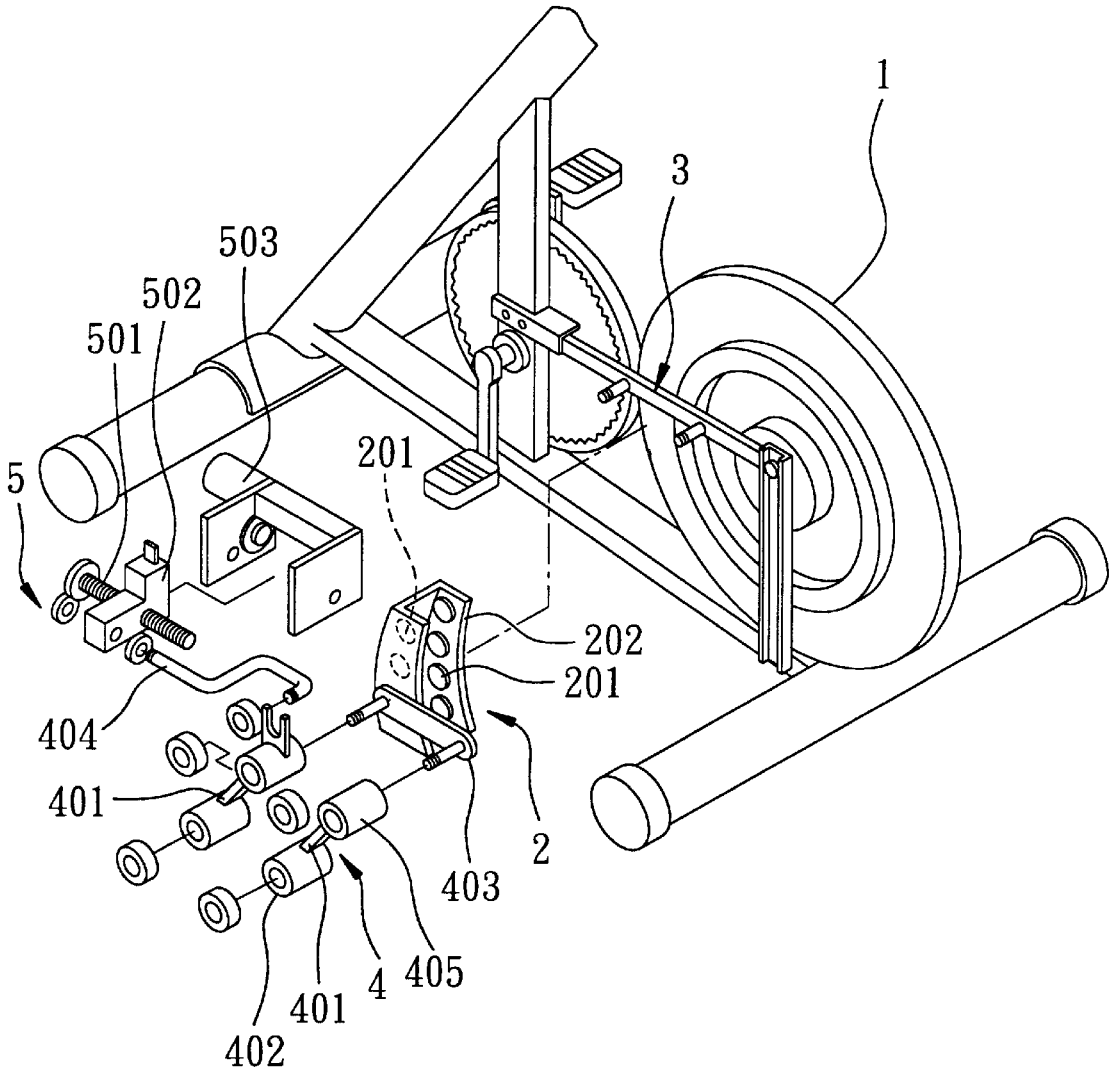
FIG. 1 PRIOR ART
FIG. 1 is an exploded perspective view of a conventional wheel-type resistance device.
Figure 2:
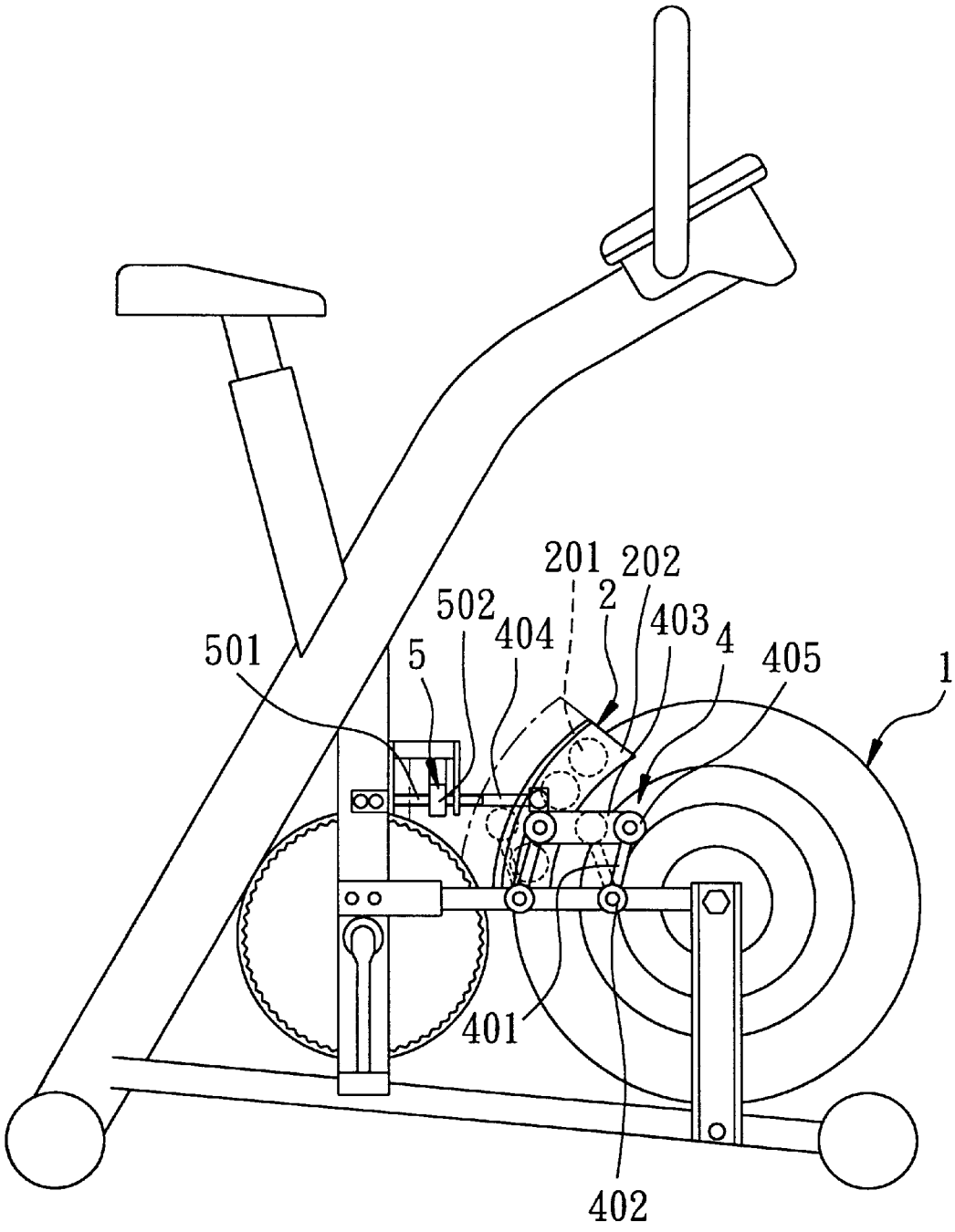
FIG. 2 PRIOR ART
FIG. 2 is a side schematic view of a bicycle exerciser that incorporates the conventional wheel-type resistance device of FIG. 1.
Figure 3:
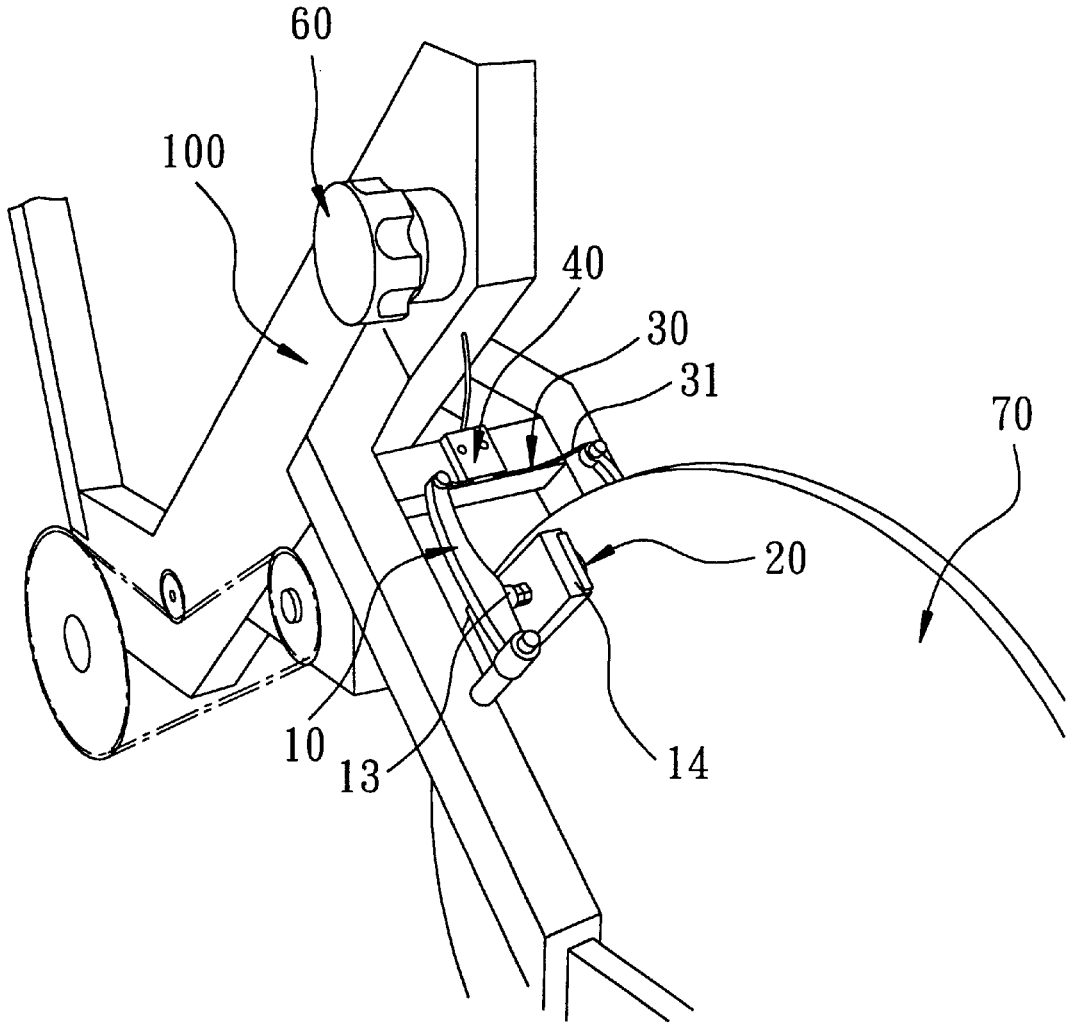
FIG. 3 is a fragmentary perspective view to illustrate a preferred embodiment of a wheel-type resistance device according to this invention when mounted on a bicycle exerciser.
Figure 4:
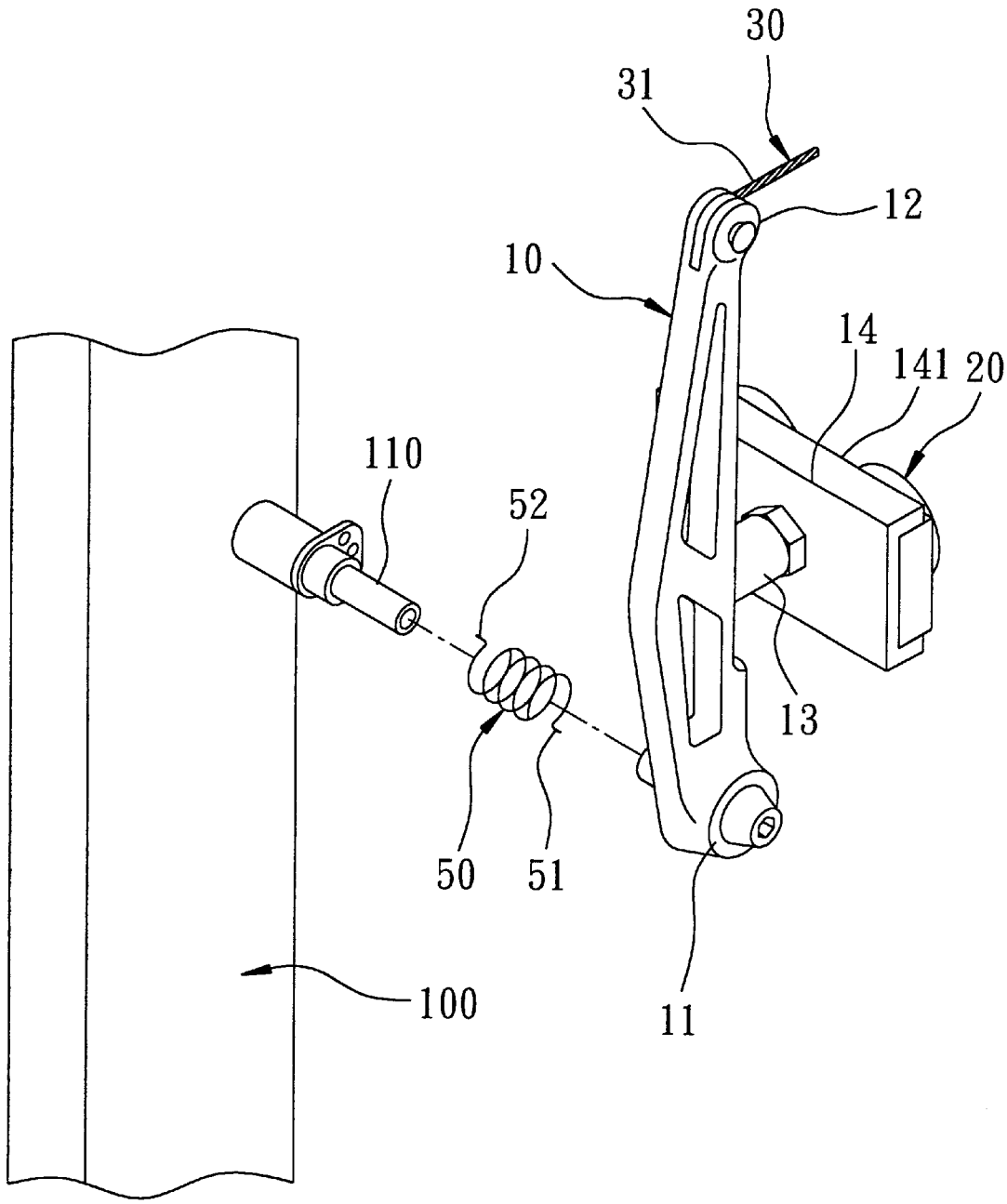
FIG. 4 is an exploded perspective view of a portion of the preferred embodiment.
Figure 5:
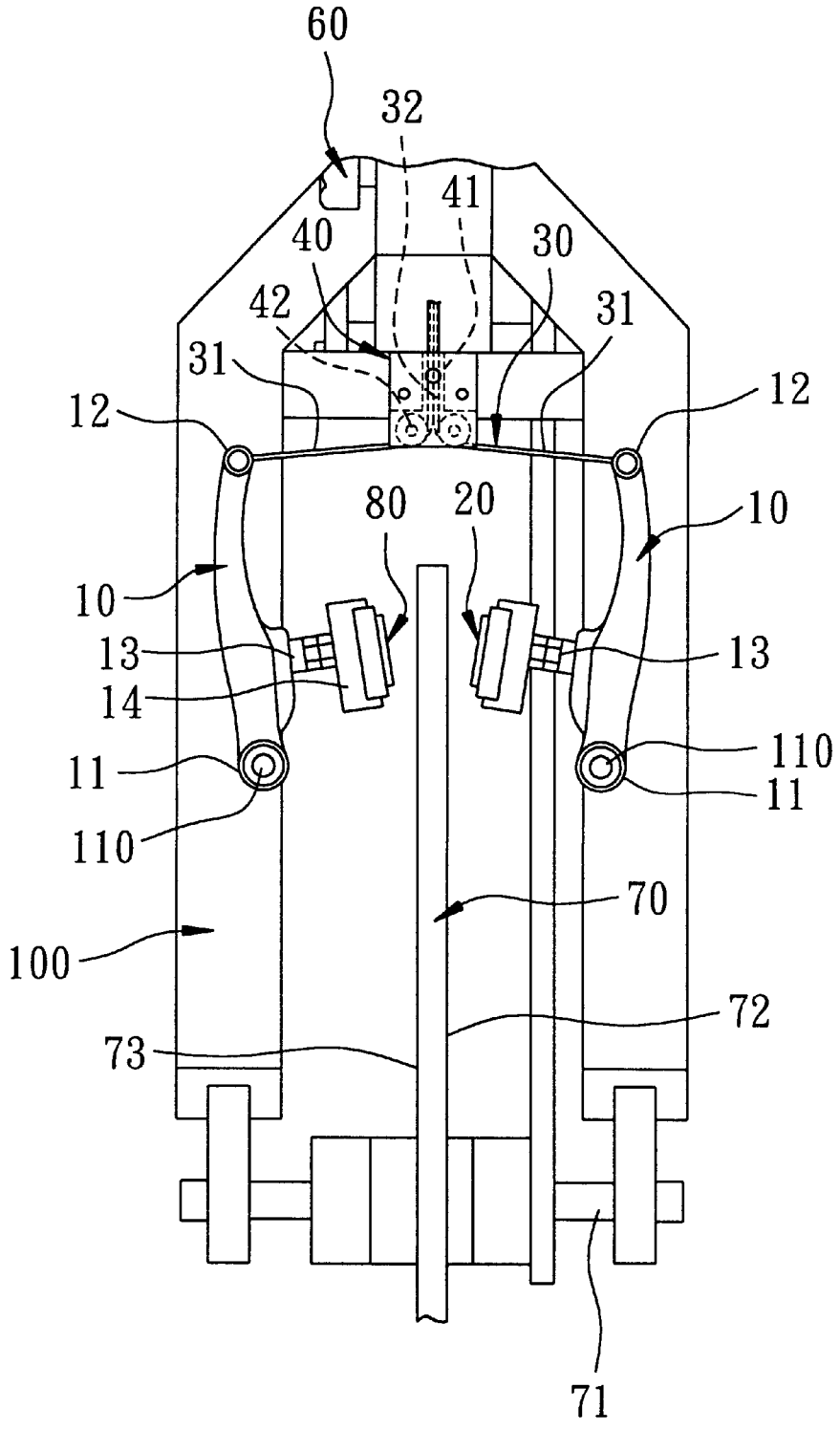
FIG. 5 is a schematic view illustrating the preferred embodiment when mounted on the bicycle exerciser.

Referring to FIGS. 3, 4, 5, and 7, the preferred embodiment of the wheel-type resistance device according to the present invention is shown to comprise a magnetically permeable flywheel 70 which is made of aluminum, and which is mounted on and which is rotatable about an axle 71 that is mounted on a frame 100 of a bicycle exerciser and that extends in an axial direction. The flywheel 70 is driven in a known manner to rotate by a pedaling action of a user, and has two side walls 72,73 opposite to each other in the axial direction. The resistance device of the preferred embodiment further comprises right and left swing arms 10, two biasing members 50, a right magnet member 20, a left magnetically attractive member 80, and a force adjusting cable 30.

Each of the right and left swing arms 10 has a pivot end 11 which is sleeved pivotally on a tube 110 secured on the exerciser frame 100 about a swing axis transverse to the axial direction of the axle 71 and outboard to the respective side wall 72,73 of the flywheel 70, and a swing end 12 which is disposed opposite to the pivot end 11 in a direction radial to the axle 71 so as to swing relative to the pivot end 11 about the swing axis to be remote from or close to the swing end 12 of the other one of the right and left swing arms 10 respectively in a first or second position. A mounting member includes a connecting rod 13 which is secured between the pivot and swing ends 11,12 and which extends in the axial direction, and a mounting seat 14 with a mounting surface 141 which is movable to be remote from or close to the respective side wall 72,73 of the flywheel 70 respectively in the first or second position.

Each biasing member 50, such as a coiled spring, is sleeved on the tube 110, and has a first end 51 which engages the pivot end 11 of the respective swing arm 10, and a second end 52 which engages the exerciser frame 100 adjacent to the tube 110 so as to bias the mounting surface 141 of the mounting seat 14 to move from the second position to the first position.

The right magnet member 20 includes a plurality of right magnets which are secured on and which are movable with the mounting surface 141 on the right swing arm 10. In this embodiment, the left magnetically attractive member 80 includes a plurality of left magnets which are secured on and which are movable with the mounting surface 141 on the left swing arm 10. The right and left magnets are disposed to correspond to each other in the axial direction, and respectively have distal ends which are attached on the mounting surfaces 141, and proximate ends which are disposed proximate to each other in the axial direction and which have opposite magnetic polarities. In addition, the proximate ends of two adjacent ones of the right magnets have opposite magnetic polarities, and the proximate ends of two adjacent ones of the left magnets have opposite magnetic polarities. As such, the movement of the right and left magnets from the first position to the second position will cause an increased dragging force on the flywheel 70 as a result of interaction between the magnetically permeable flywheel 70 and an increased strength of magnetic field established between the right and left magnets.

Figure 6:
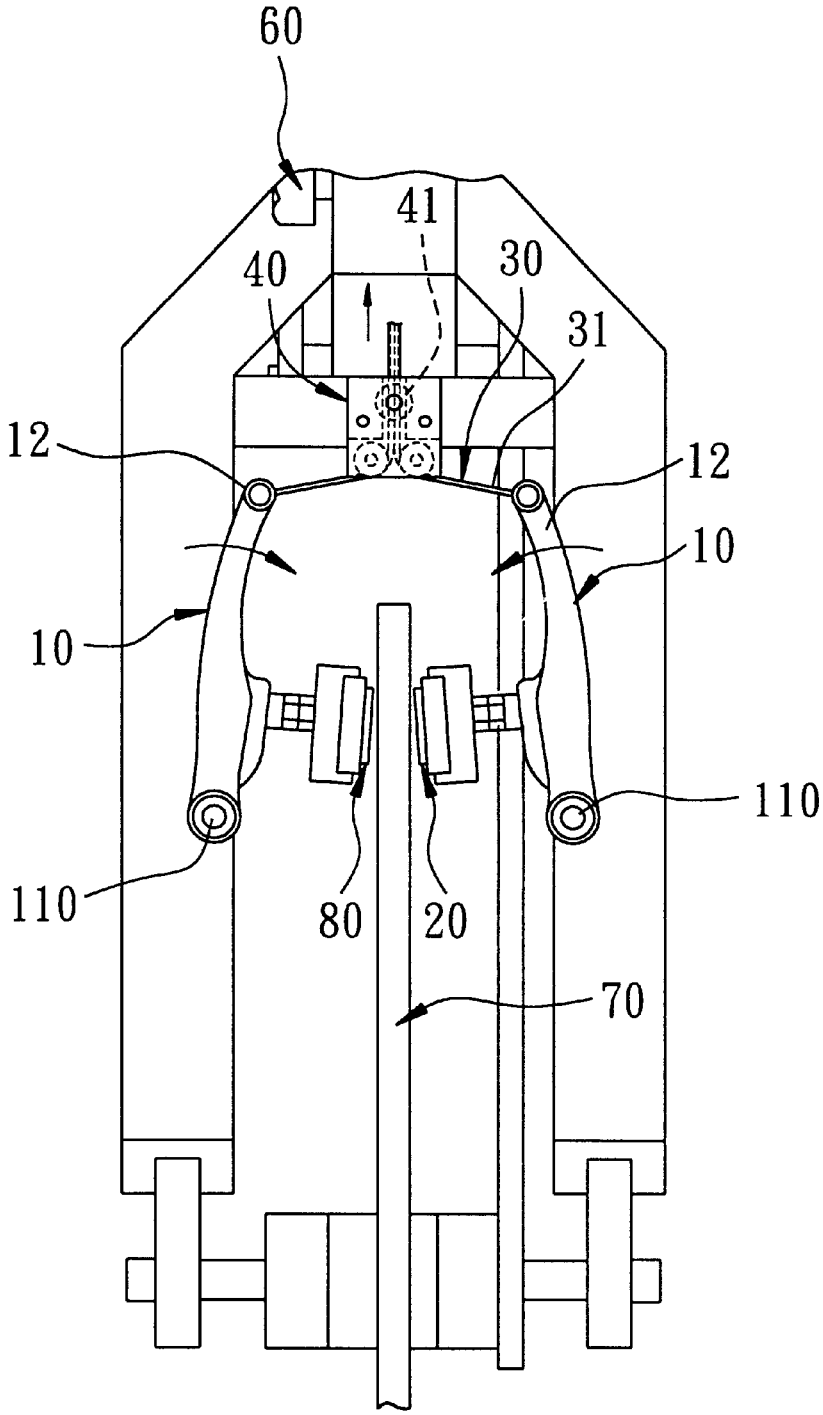
FIG. 6 is a schematic view illustrating the preferred embodiment when a force adjusting cable thereof is pulled.
Figure 7:
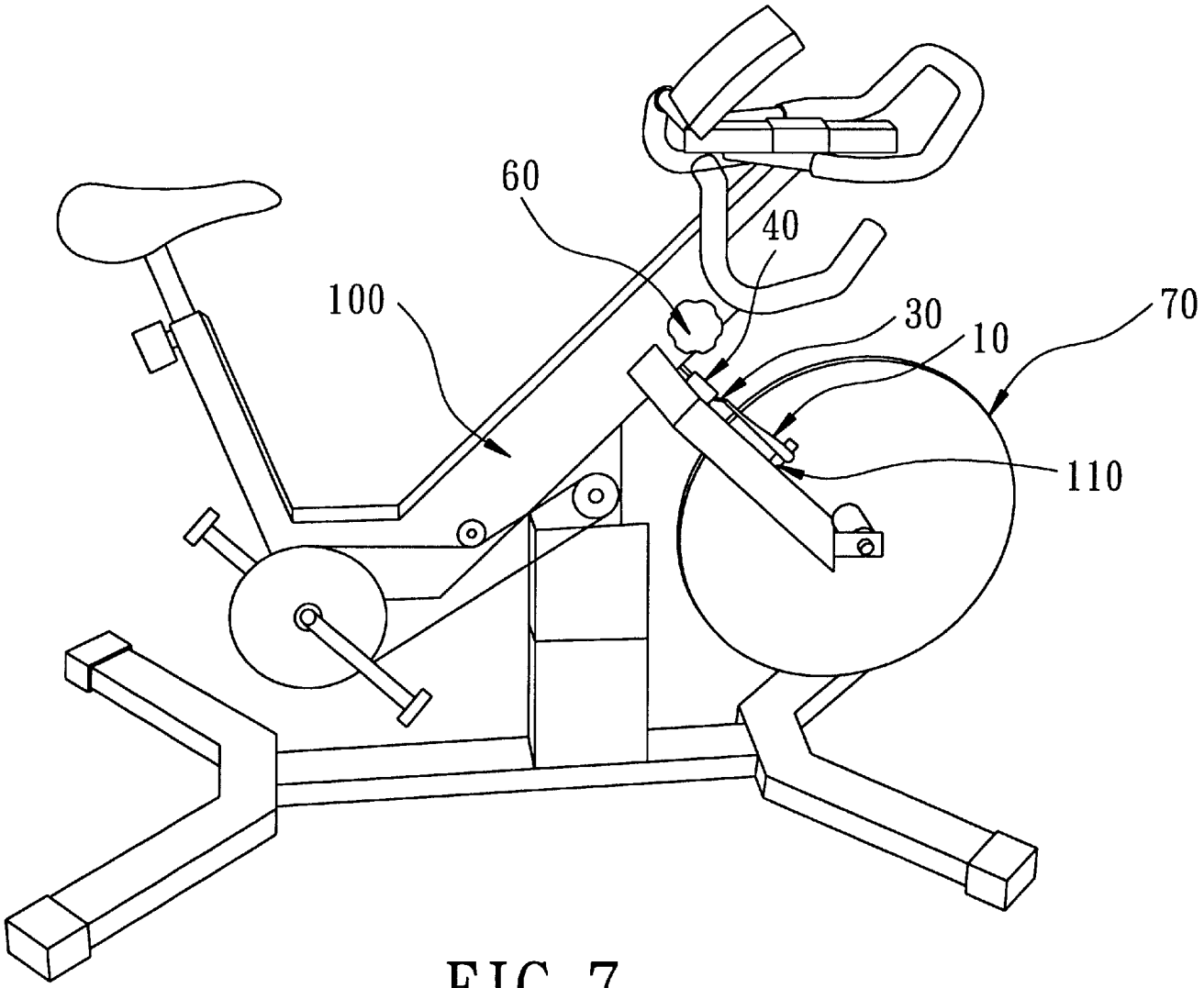
FIG. 7 is a perspective view to illustrate the preferred embodiment when mounted on the bicycle exerciser.

The force adjusting cable 30 has two cable ends 31 which are respectively and tensely connected to the swing ends 12 of the right and left swing arms 10, and an intermediate portion 32 which is disposed between the cable ends 31 and which are trained on two guiding pulleys 42 of a connecting seat 40. The intermediate portion 32 of the cable 30 further extends along a rail 41, and is wound on a rotary knob 60. Thus, with reference to FIG. 6, rotation of the rotary knob 60 can wind the cable 30 to pull the swing ends 12 of the swing arms 10 against the action of the biasing members 50 to the second position, thereby bringing the right and left magnets to the second position.

As illustrated, the wheel-type resistance device according to this invention has a simple construction that is easy to fabricate at relatively low manufacturing and maintenance costs.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A wheel-type resistance device for providing a resisting force to a bicycle exerciser, comprising:

an axle adapted to be mounted on a frame of the bicycle exerciser and extending in an axial direction;

a magnetically permeable flywheel mounted on and rotatable about said axle, said flywheel being driven to rotate by a pedaling action, and having two side walls opposite to each other in the axial direction;

right and left swing arms, each having a pivot end adapted to be mounted pivotally on the frame of the bicycle exerciser about a swing axis transverse to the axial direction and outboard to a respective one of said side walls of said flywheel, a swing end disposed opposite to said pivot end in a direction radial to said axle so as to swing relative to said pivot end about the swing axis to be remote from or close to said swing end of the other one of said right and left swing arms respectively in a first or second position, and a mounting member disposed between said pivot and swing ends and extending in the axial direction to terminate at a mounting surface which is remote from or close to said respective one of said side walls respectively in the first or second position;

two biasing members, each disposed to bias said mounting surface to move from the second position to the first position;

a right magnet member mounted on and movable with said mounting surface of said right swing arm;

a left magnetically attractive member mounted on and movable with said mounting surface of said left swing arm, wherein the movement of said right magnet member and said left magnetically attractive member from the first position to the second position will cause an increased dragging force on said flywheel as a result of interaction between said magnetically permeable flywheel and an increased strength of magnetic field established between said right magnet member and said left magnetically attractive member; and a force adjusting cable having two cable ends respectively and tensely connected to said swing ends of said right and left swing arms, and an intermediate portion disposed between said cable ends and adapted to be pullably disposed on the frame of the bicycle exerciser, said intermediate portion being operable to pull said swing ends against the action of said biasing members to the second position, thereby bringing said right magnet member and said left magnetically attractive member to the second position.

2. The wheel-type resistance device of claim 1, wherein said right magnet member and said left magnetically attractive member respectively include a plurality of right magnets and a plurality of left magnets, said right and left magnets respectively corresponding to each other in the axial direction, and respectively having distal ends which are attached on said mounting surfaces of said right and left swing arms, and proximate ends which are disposed proximate to each other in the axial direction and which have opposite magnetic polarities, said proximate ends of two adjacent ones of said right magnets having opposite magnetic polarities, said proximate ends of two adjacent ones of said left magnets having opposite magnetic polarities.

3. The wheel-type resistance device of claim 2, wherein each of said biasing members is a coiled spring having a first end that engages said pivot end of a respective one of said right and left swing arms, and a second end adapted to engage the frame of the bicycle exerciser.

4. The wheel-type resistance device of claim 2, further comprising a guiding pulley which is adapted to be mounted on the frame of the bicycle exerciser for training said intermediate portion of said cable thereon.

* * * * *